US006783013B1

(12) United States Patent
Spann

(10) Patent No.: US 6,783,013 B1
(45) Date of Patent: Aug. 31, 2004

(54) DUAL RAIL TOOL HOLDER

(75) Inventor: Richard N Spann, Carlisle, MA (US)

(73) Assignee: Richard N. Spann, Carlisle, MA (US)

( * ) Notice: Subject to any disclaimer, the term of this patent is extended or adjusted under 35 U.S.C. 154(b) by 0 days.

(21) Appl. No.: 09/757,255

(22) Filed: Jan. 9, 2001

Related U.S. Application Data

(60) Provisional application No. 60/176,332, filed on Jan. 14, 2000.

(51) Int. Cl.[7] ..... A47F 7/00

(52) U.S. Cl. ..... 211/70.6; 211/60.1; 248/520; 248/146

(58) Field of Search ..... 211/65, 70.6, 70.1, 211/60.1, 69.1, 70.7–70.8, 70.4–70.5, 68, 89.01; 248/309.1, 515, 511–512, 519, 534, 540, 538, 110, 520, 523, 524, 530, 532, 539, 62, 63, 229.1, 229.2, 316.8, 316.6, 127; 206/443, 349

(56) References Cited

U.S. PATENT DOCUMENTS

| | | | | | |
|---|---|---|---|---|---|
| 742,581 | A | * | 10/1903 | Burtch | 211/65 |
| 838,473 | A | * | 12/1906 | Speiser | 211/65 |
| 1,388,154 | A | * | 8/1921 | Coutts | 211/44 |
| 1,445,029 | A | * | 2/1923 | Orrill | 211/65 |
| 1,733,868 | A | | 10/1929 | Durell | |
| 1,759,202 | A | * | 5/1930 | Nelson | 211/96 |
| 1,841,753 | A | * | 1/1932 | Merkle | 211/65 |
| 2,032,631 | A | * | 3/1936 | Pushee | 211/65 |
| 2,584,644 | A | * | 2/1952 | Verdi | 211/65 |
| 2,587,226 | A | * | 2/1952 | Rodman | 211/65 |
| 2,855,107 | A | * | 10/1958 | Roth | 211/60.1 |
| 2,916,159 | A | * | 12/1959 | O'Neill | 211/89.01 |
| 3,004,673 | A | * | 10/1961 | Emery | 211/60.1 |
| 3,298,531 | A | | 1/1967 | Wilcke | |
| 4,003,612 | A | * | 1/1977 | Munsell | 312/245 |
| 4,515,332 | A | * | 5/1985 | Scharfy | 248/37.3 |
| 4,730,799 | A | * | 3/1988 | Foss et al. | 248/51 |
| 4,775,054 | A | * | 10/1988 | Dixon | 211/57.1 |
| 4,947,998 | A | | 8/1990 | Smeller | |
| 4,966,288 | A | * | 10/1990 | Kirkham | 211/60.1 |
| 5,038,945 | A | * | 8/1991 | Melkonian | 211/96 |
| 5,092,463 | A | | 3/1992 | Dees | |
| 5,129,528 | A | * | 7/1992 | Eidsmoe et al. | 211/70.6 |
| 5,143,228 | A | | 9/1992 | Arnold | |
| 5,244,700 | A | * | 9/1993 | Banschick | 211/13.1 |
| 5,390,944 | A | | 2/1995 | Sherwin | |
| 5,487,475 | A | * | 1/1996 | Knee | 211/70.8 |
| 5,573,115 | A | | 11/1996 | Fuller | |
| 5,704,496 | A | | 1/1998 | Latta | |
| 5,743,414 | A | * | 4/1998 | Baudino | 211/69.1 |
| 5,788,092 | A | | 8/1998 | Teeney | |
| 5,806,822 | A | * | 9/1998 | Schulz | 248/309.1 |
| 5,810,177 | A | | 9/1998 | Cabiran | |
| 5,833,250 | A | | 11/1998 | Schier et al. | |
| 5,843,388 | A | * | 12/1998 | Arroyo et al. | 211/70.6 |
| 6,027,081 | A | * | 2/2000 | Rosenberg | 248/37.6 |
| 6,209,732 | B1 | * | 4/2001 | Dennis et al. | 211/70.6 |
| 6,299,000 | B1 | * | 10/2001 | Cabrera | 211/70.2 |
| 6,412,735 | B1 | * | 7/2002 | Mathieu | 248/110 |
| 2002/0066707 | A1 | * | 6/2002 | Manix et al. | 211/70.6 |
| 2002/0113030 | A1 | * | 8/2002 | Belisle | 211/85.7 |
| 2003/0000902 | A1 | * | 1/2003 | Keis et al. | 211/89.01 |

FOREIGN PATENT DOCUMENTS

| | | | | |
|---|---|---|---|---|
| AU | 275839 | * | 5/1967 | 211/70.6 |

* cited by examiner

*Primary Examiner*—Jennifer E. Novosad
(74) *Attorney, Agent, or Firm*—Testa, Hurwitz & Thibeault, LLP

(57) ABSTRACT

A dual rail tool holder may be used to store and organize garden and lawn tools with long handles in an inverted position, as well as to store and organize accessories. The tool holder consists of a first rail and a second rail, that are vertically and horizontally offset from each other forming an opening therebetween. Ends of tool handles are inserted in the opening between the rails and are stored in a generally vertical orientation.

7 Claims, 6 Drawing Sheets

DUAL RAIL TOOL HOLDER

RELATED APPLICATIONS

This application claims the benefit of and priority to U.S. provisional patent application Serial No. 60/176,332, filed Jan. 14, 2000, the disclosure of which is incorporated herein by reference in its entirety.

TECHNICAL FIELD

This invention relates to organizers in general and more particularly to organizers for articles having elongate members, such as garden and lawn tools having cylindrical handles or other types of handles, as well as organizers that provide storage and organization for articles not having elongate members by using support structures.

BACKGROUND INFORMATION

Many households have a variety of garden and lawn tools, as well as recreational tools and the like, with elongate handles, such as rakes, shovels, brooms, etc. These items do not fit in conventional drawers and are often stored on end in a comer of the room leaning against a wall, in a barrel of some type, on a wall rack, or on hooks. Some homeowners simply lay them on the floor.

All of these storage methods have significant disadvantages. For example, rakes and brooms do not fit well in the comer in an inverted vertical position and are unstable when simply stood against the wall. A stack of elongate tools standing on end is prone to sliding and falling, creating both clutter and a safety hazard. Additionally, when the number of tools stored in such a way increases, retrieving an item becomes difficult because it is often necessary to disassemble the entire stack to get to the desired tool, and then reassemble the stack. Similarly, storing tools in a heap on the floor complicates retrieval, creates clutter, and takes up a substantial amount of space.

While hanging tools from hooks or supports attached to a wall is a space-saving method, which advantageously permits tools to be organized, a number of practical limitations and disadvantages arise. For example, this method requires a plurality of hooks and supports to be rigidly mounted in some stationary arrangement to accommodate a particular set of tools. Accordingly, to achieve adequate organization after using the tools, they generally must be returned to their original arrangement. This complicates the use of such supports, especially when multiple users remove several tools simultaneously. This often leads to returning the tools to the wrong holders, which in turn leads to disorganized and unsafe storage of the tools.

Additionally, placement and removal of tools from wall-mounted supports can require some amount of skill and precision. Similarly, when the stored tools are intended for use by multiple users of substantially different height, strength, and arm reach, as it is often the case in households with small children or elderly family members, it is difficult to choose a location for the supports on the wall which is both convenient and safe for all users. Moreover, if more tools are added to the collection, often the only way to accommodate them is to demount the supports and rearrange them on the wall to make room for the new additions. Storage of tools that do not have any openings or protuberances present a problem as they do not possess any means for readily holding the tool in the support; thus, they simply cannot be safely stored on hooks or other wall-mounted supports. Lastly, any generally linear arrangement of hooks or supports can also be problematic in that, unless staggered vertically or widely separated horizontally, tool heads can overlap, making removal difficult or requiring removal of more than one tool to access the tool of choice.

To remedy and overcome these difficulties, a variety of three-dimensional tool organizers have been proposed, which provide for inverted vertical storage of these tools with handles pointing downwards and utility heads pointing upwards. See, for example, U.S. Pat. No. 4,947,998 to Smeller, U.S. Pat. No. 5,390,944 to Sherwin, U.S. Pat. No. 5,833,250 to Schier, and U.S. Pat. No. 5,810,177 to Cabiran, the disclosures of which are incorporated herein by reference in their entirety.

Many of these tool organizers known in the art have a bulky body with a substantial footprint. Such a configuration renders these organizers difficult to use in confined spaces, such as between a garage wall and a car, or between cars. Additionally, some organizers limit the ability of the user to organize the tools as desired, because the organizer may have a certain number of specific mounts or locations designed for particular types of tools. This complicates the use of such organizers by limiting the number of locations a particular tool may be returned to and often leads to disorganization.

Finally, many of the organizers known in the art require substantial lifting of tools in order to insert or remove them from the organizer. This complicates and often prohibits using such organizers in low overhead environments, as well as by children and the elderly.

There exists, therefore, a significant need for a tool holder that affords a convenient and flexible way to store a collection of tools efficiently in a three-dimensional space while providing easy insertion and removal and fault-free return by multiple users. In particular, there is a need for a tool holder which can easily store and organize tools with elongate members, such as lawn and garden tools, in a limited height, low-overhead space, such as may be found in a garage, a lawn and garden shed, or on a patio. Further, there is a need for a tool holder which can be used against finished walls, near windows, between cars in a garage, and elsewhere where conventional wall-mounted organizers cannot be used. Additionally, there exists a need for a freestanding tool holder capable of holding the tools in a generally linear or regular arrangement.

SUMMARY OF THE INVENTION

With the foregoing in mind, the present invention eliminates or substantially alleviates the foregoing disadvantages of organization and storage devices known in the prior art.

In general, the invention includes a first rail and a second rail vertically and horizontally offset from each other forming an opening therebetween for receiving an elongate member in a generally vertical orientation.

In some embodiments, the rails may be substantially flat, generally parallel crossbars further characterized by generally opposed edges for contacting the elongate member when inserted therebetween. In other embodiments, the rails may be a first hoop and a second hoop generally concentric therewith, further characterized by generally opposed edges for contacting the elongate member when inserted therebetween.

The rails may have at least one depression along an edge thereof or at least two depressions along opposing edges, which can be horizontally or radially aligned with each other to restrict lateral movement of the elongate member when disposed therein.

In one aspect of the invention, a stable structure may be formed by two end plates attached to side edges of the crossbars. With the hoops, a stable structure may be formed by one or more legs attached to the hoops or by arranging the hoops so that the tools lean radially inwardly. In another aspect of the invention, outward extents of the end plates, hoops, or optional legs define a footprint of the tool holder. If a vertical projection through a center of gravity of any elongate member inserted between the crossbars or hoops lies within the footprint, the tool holder is stable and will not tip, regardless of the number, type, or location of tools being stored. Another advantage is that tools can be rotated in place relatively easily, thereby eliminating tool head interference without having to remove the tools. As a result, tool heads can be oriented with their major axes perpendicular to the major axis or length of the tool holder in order to ease insertion and removal and to maximize the number of tools for a given tool holder length.

Further embodiments of the invention are drawn to use of at least one elongate member having at least one support for supporting at least one item thereon when the elongate member is inserted between the rails. Additionally or alternatively, the elongate member may have a shelf disposed on the support.

Also contemplated by the present invention are associated methods for organizing and storing articles with elongate members, as well as articles without elongate members. In a general embodiment of the method of the present invention, a first rail and a second rail are provided vertically and horizontally offset from each other forming an opening therebetween for receiving an elongate member in a generally vertical orientation.

These and other objects, along with advantages and features of the present invention herein disclosed, will become apparent to those skilled in the art through reference to the following description of various embodiments of the invention, the accompanying drawings, and the claims.

BRIEF DESCRIPTION OF THE DRAWINGS

In the drawings, like reference characters generally refer to the same parts throughout the different views. Also, the drawings are not necessarily drawn to scale, emphasis instead generally being placed upon illustrating the principles of the invention.

DETAILED DESCRIPTION

Embodiments of the present invention are described below. It is, however, expressly noted that the present invention is not limited to these embodiments, but rather the intention is that all equivalents and modifications that are obvious to a person skilled in the art are also included. In particular, the present invention is not intended to be limited to use with garden tools, but rather to use with any article having an elongate member which can be stored in a generally vertical position, such as hockey sticks, fishing poles, pool maintenance equipment, and the like. The term tool, as used herein, includes any article having an elongate member, such as a generally cylindrical handle or a post. The phrases vertical position and vertical orientation as used herein, refer to the ranges of angle from about zero degrees to about 45 degrees from vertical.

Figure 1:
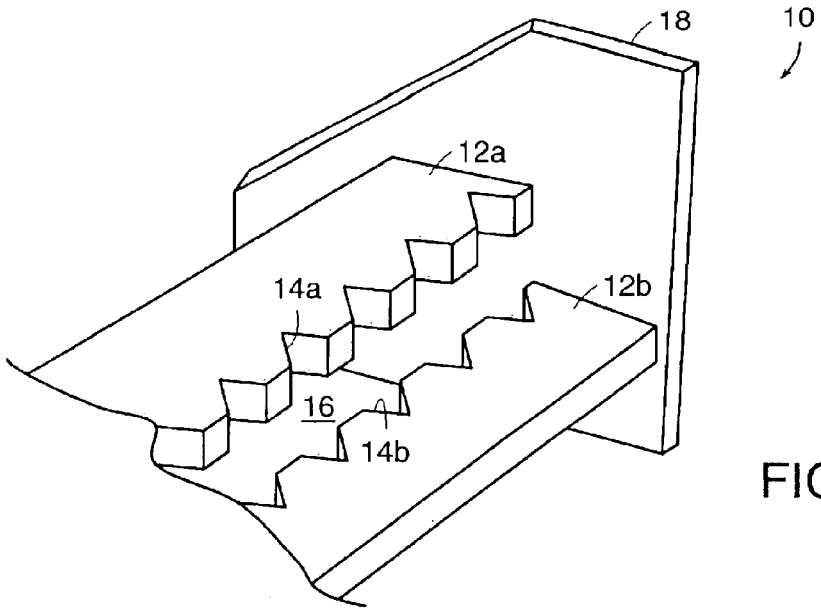
FIG. 1 is a schematic perspective view of a portion of a tool holder according to one embodiment of the invention.

FIG. 1 shows a partial perspective view of a tool holder 10 according to one embodiment of the present invention. The tool holder 10 is shown with two rails. The depicted rails are generally flat, generally parallel crossbars 12*a*, 12*b* which are vertically and horizontally offset from each other; however, the rails could be rods or other shaped structures similarly offset and spaced. Two generally opposed depressions 14*a*, 14*b* are formed along inside edges of the crossbars 12. The depressions 14*a*, 14*b* are horizontally aligned, although vertically offset, and define an opening 16 therebetween for receiving therein a lower end of an elongate member. A stable structure is formed by attaching end plates 18 to respective ends of the crossbars 12*a*, 12*b*.

Figure 2:
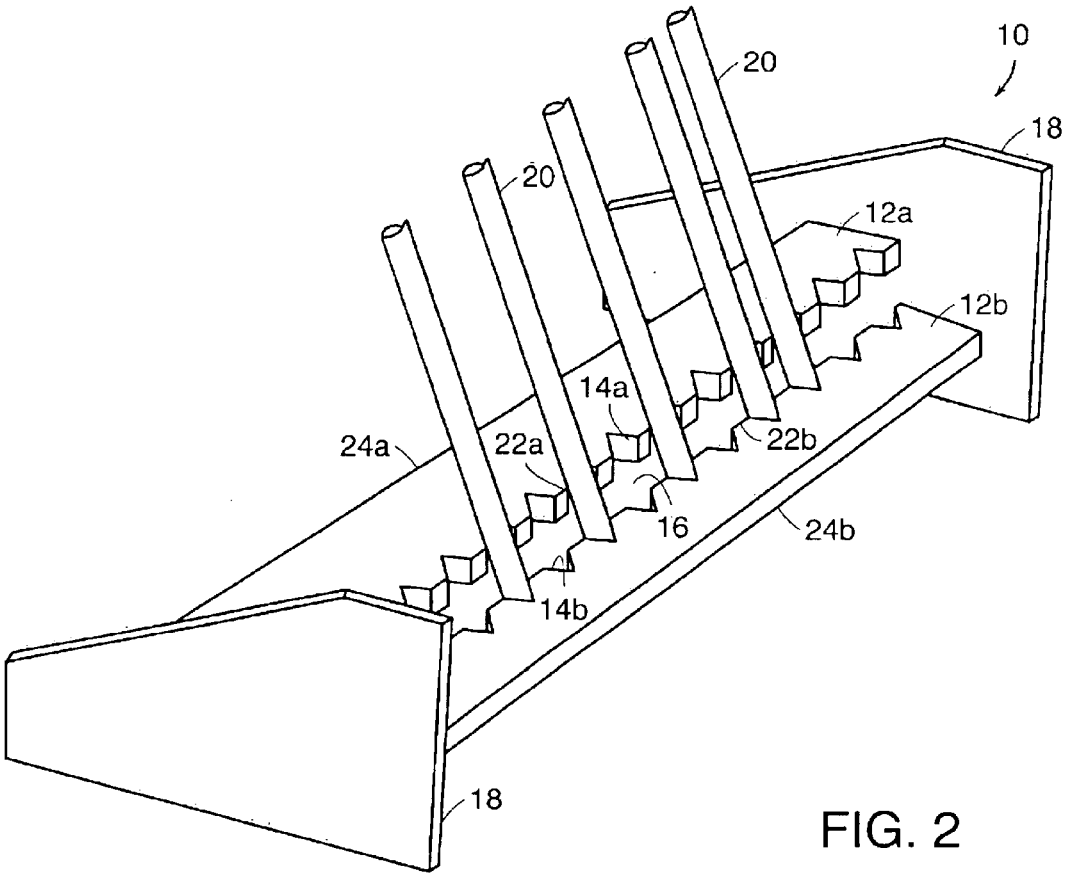
FIG. 2 is a schematic perspective view of the complete tool holder of FIG. 1 with a plurality of elongate members inserted therein.

FIG. 2 shows a perspective view of the entire tool holder 10 shown in FIG. 1 supporting a plurality of elongate members 20. The elongate members 20 are inserted in the spaces 16 defined by a series of opposing depressions 14*a*, 14*b*. The depressions 14*a*, 14*b* can be of any shape and are useful in preventing the elongate members 20 from moving laterally or slipping. Examples of suitable shapes for the depressions 14*a*, 14*b* can include, but are not limited to, squares, rectangles, triangles, semi-circles, semi-ellipses, a sinusoidal waveform, etc. Other arcuate and linear edged shapes and combinations thereof will be apparent to those skilled in the art FIGS. 1–3A depict depressions 14*a*, 14*b* resembling open triangles or wedges. One advantage of using triangularly-shaped depressions 14*a*, 14*b* is that they work well for elongate members 20 with symmetrical cross-sections, such as generally cylindrical tool handles. Such elongate members 20 are typical of handles found on many articles, such as shovels, rakes, hoes, and other common garden tools. These circular cross-sections are of relatively small diameter, so as to fit comfortably within the palm of a user's hand. Another advantage of triangular-shaped depressions 14*a*, 14*b* is that the shape provides a relatively wide opening, facilitating insertion and self-centering of the elongate members 20, while securely retaining the members 20 in the center of the notches provided by the apexes of the triangles.

Figure 3A:
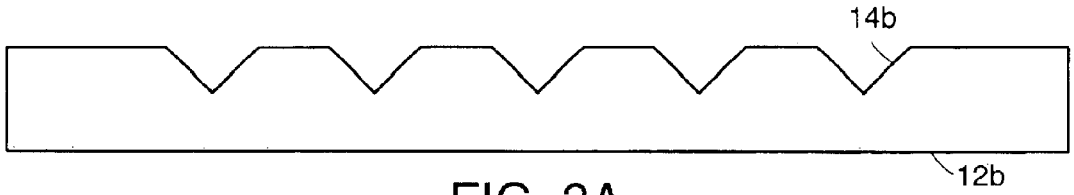
FIG. 3A is a schematic plan view of a rail according to one embodiment of the invention.
Figure 3B:
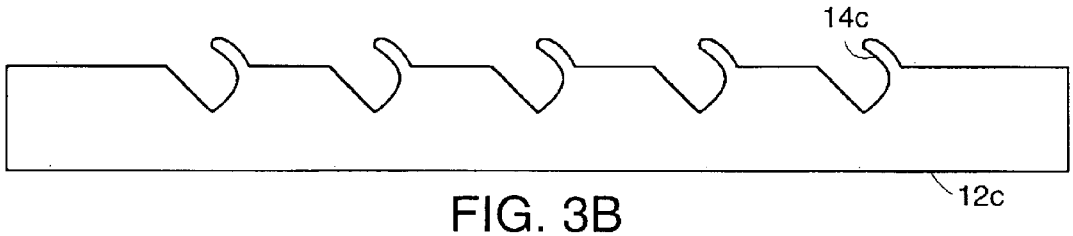
FIG. 3B is a schematic plan view of a rail according to another embodiment of the invention.

The depressions 14*a*, 14*b*, however, can be manufactured to be of any shape or size to accommodate different sized and shaped member cross-sections, or to satisfy an aesthetic purpose. The shape of the depressions 14*a* on the upper crossbar 12*a* may be the same as or different from the shape of the depressions 14*b* on the lower crossbar 12*b*. One example of an instance where different depression shapes may be useful is in forming a depression 14*c* in a crossbar 12*c* having at least one curved or arcuate shape, such as a general C or S shape to further prevent the elongate member 20 from accidentally becoming dislodged from its resting position, as shown in FIG. 3B. An elongate member 20 can be nested more securely against lateral slippage in the curved depression 14*c*. Due to the more positive retention of the elongate member 20 within the crossbar 12*c*, it is more difficult for the elongate member 20 to accidentally become dislodged from its resting position and pivot about the lower crossbar. It is, however, generally desirable that the shape of the depressions 14*a*, 14*b*, and 14*c* in the crossbars 12*a*, 12*b*, and 12*c*, respectively, be of a simple shape for ease in inserting and removing the elongate members 20. In alternative embodiments, solely one crossbar, such as an upper crossbar, may include depressions, with the lower crossbar having an uninterrupted edge.

Referring again to FIG. 2, the elongate members 20 are held in a generally vertical orientation by the crossbars 12*a*, 12*b*. The elongate members 20 rest against the upper crossbar 12*a* and are prevented from pivoting excessively and falling to the ground by the lower crossbar 12*b*. The horizontal and vertical distances between the crossbars 12*a*, 12*b*, the depth of any depressions 14*a*, 14*b*, and the cross-sectional size and shape of the elongate member 20 determines the slope or lean of the elongate member 20 from vertical. Typically, the smaller the horizontal distance between the crossbars 12*a*, 12*b*, the less lean and more vertical the elongate member 20 will rest. Conversely, the greater the horizontal distance between the crossbars 12*a*, 12*b* the more the elongate member 20 will lean. The vertical distance between the crossbars 12*a*, 12*b* also affects lean, as well as the reaction forces exerted on the elongate member. The smaller the vertical distance between the crossbars 12*a*, 12*b* for a fixed horizontal spacing, the greater the induced moment and resultant applied force. Conversely, the greater the vertical distance between the crossbars 12*a*, 12*b* for a fixed horizontal spacing, the smaller the induced moment and resultant applied force.

The vertical location of the lower crossbar 12*b* in relation to the ground determines how high a user will have to lift the elongate member 20 to insert the member 20 into, or remove the member 20 from, the tool holder, because the lower tip of the elongate member 20 must clear the lower crossbar 12*b* before it can rest in the depressions 14*a*, 14*b*. The lower the lower crossbar 12*b* is positioned on the end plates 18 (i.e., the closer the lower crossbar 12*b* is to the ground), the less effort a user will have to exert to insert the elongate member 20 in, or remove the elongate member 20 from, the tool holder 10. In the limit, the lower crossbar 12*b* can rest on the ground. Additionally, the lower the upper crossbar 12*a* is positioned on the end plates 18 (i.e., the closer the upper crossbar 12*a* is to the ground), the less effort a user will have to exert to insert the elongate member 20 in, or remove the elongate member from, the tool holder 10 from the opposite side.

The angle of the crossbars 12*a*, 12*b* relative to the ground can also be varied. One or both crossbars 12*a*, 12*b* can be angled upwards or downwards toward the center of the holder 10. When the upper crossbar 12*a* is angled upwards (i.e., the inside edge 22*a* of the upper crossbar 12*a* of the tool holder 10 is higher than the outside edge 24*a*) or when the lower crossbar 12*b* is angled downwards (i.e., the inside edge 22*b* of the lower crossbar 12*b* is lower than the outside edge 24*b*), the force exerted by the elongate member 20 can be distributed across the entire respective thicknesses of the crossbars 12*a*, 12*b* and not merely on top and bottom edges of the crossbars 12*a*, 12*b*.

The shape of the endplates 18 shown in FIG. 2 is an irregularly shaped pentagon. The endplates 18, however, can be of any size and shape, with consideration given to their ability to support the crossbars 12*a*, 12*b* and form a stable structure with a sufficiently large footprint to prevent tipping of the tool holder when partially and fully loaded with elongate members 20. The endplates 18 may also include legs or extensions to provide additional stability, if desired; however, if properly designed, such features are not required. Additionally, one or more intermediate endplates can also be disposed along the length of the tool holder 10 to add strength and stability to the structure by bracing the crossbars 12*a*, 12*b* at a midpoint or elsewhere.

Figure 4:
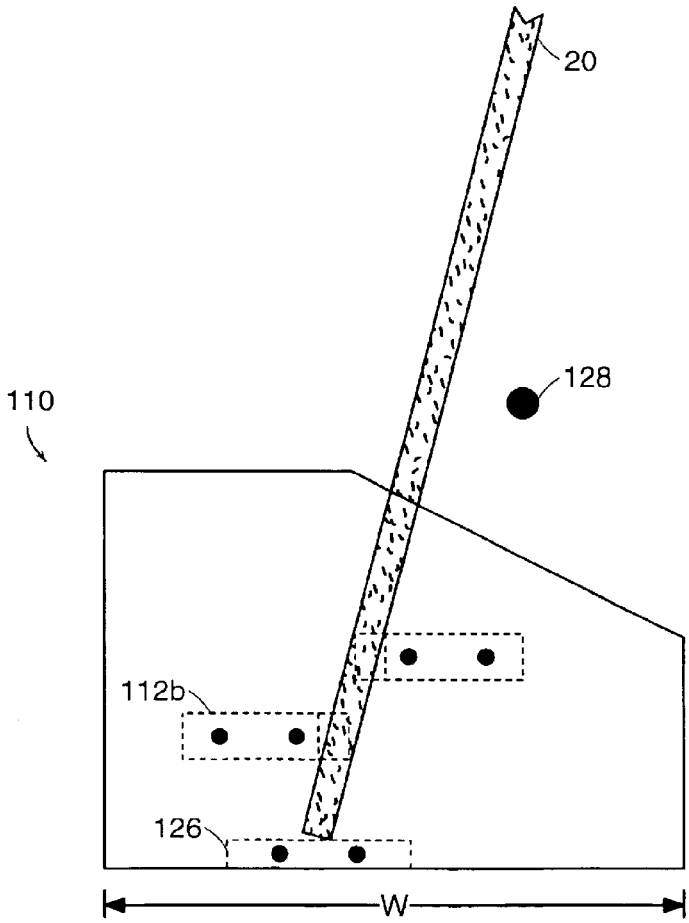
FIG. 4 is a schematic side view of a tool holder according to an embodiment of the invention.

FIG. 4 shows an end view of another embodiment of the present invention. The tool holder 110 has an optional base plate 126 disposed below the lower crossbar 112*b*. The base plate 126 is sufficiently wide to support an end of the elongate member 20 when inserted in the tool holder 110. The base plate 126 may extend partially or fully along the length of the tool holder 110, as well as the along the width. The base plate 126 prevents the elongate member 20 lower end from touching the ground. The base plates 126 can be especially helpful in situations where the tool holder 110 is to be moved with the elongate members 20 still loaded. Such a base plate 126 could also be used with tool holders which do not rest directly on the ground, such as those mounted to a wall or those raised slightly on wheels to facilitate movement. The base plate 126 can also be used to add further structural integrity to the tool holder 110 or to add weight to provide additional stability.

It is desirable that the tool holder be stable when in use, without regard to the number and combination of tools stored therein, so that the weight of the tools or an accidental contact with a tool does not dislodge the tools. The stability of the tool holder 10 can be enhanced by a variety of methods. One method is to design the tool holder 10 so that a vertical projection through the center of mass 128 of any loaded tool is within the bounds of a footprint created by the outward extents of the end plates. The footprint is defined by the width W of the end plates as depicted, for example, in FIG. 4 and the overall length of the tool holder 10. As long as the vertical projection of the center of mass 128 of each tool and therefore the aggregate center of mass of all of the tools does not extend beyond the footprint, the tool holder 10 and tools stored therein will be stable. Naturally, the closer the aggregate center of mass of the tools is to the center of the width and length of the tool holder 10, the more stable the tool holder 10 will be. The end plates may optionally include fixed or retractable legs. The more the legs extend beyond the width of the endplates, the larger the footprint, resulting in a more stable structure. Legs may also extend longitudinally, if desired.

Another method of stabilizing the tool holder 10 is by increasing the mass of the holder 10 so that it will remain stable regardless of the number, size, or shape of the tools placed therein. Increasing the mass of the tool holder 10 can be accomplished by using heavy materials in the construction of the holder 10. Mass can also be increased by adding additional "weight-bearing elements," such as sand, water, rocks, cement blocks, metal plates, etc. Other weight bearing elements will be apparent to those skilled in the art. A reservoir or trough can be formed in or added to the tool holder 10 to contain the weight-bearing elements. Alternatively, the reservoir can be a hollow portion of the tool holder 10, such as hollow crossbars 12*a*, 12*b* that can be filled with water or sand by pouring the material through an opening therein. Removal can be accomplished easily through the same opening or a different opening located on a bottom side of the reservoir. Finally, optional attachment devices can be added to the tool holder 10 to removably anchor the holder to a support located on a wall or a floor. Other methods and structure for stabilizing the tool holder 10 will be apparent to those skilled in the art.

It is also desirable that the tools remain in their resting position until intentionally moved by a user. One manner of ensuring against accidental dislodgment of the tools is to increase the horizontal distance between the crossbars 12*a*, 12*b*. The more horizontal the tool rests, the greater the force needed to dislodge the tool from its resting position such that it topples in a direction away from the rest position. The more horizontal the tools lie, however, the greater the space and generally the footprint needed to store the tools in a stable manner. If a more compact tool holder 10 is desired, then it is generally more beneficial for the tool to rest in a generally vertical position. The more vertical the tool stands, however, the less force will be required to dislodge the tool from its resting position in the depressions 14*a*, 14*b*.

Figure 5:
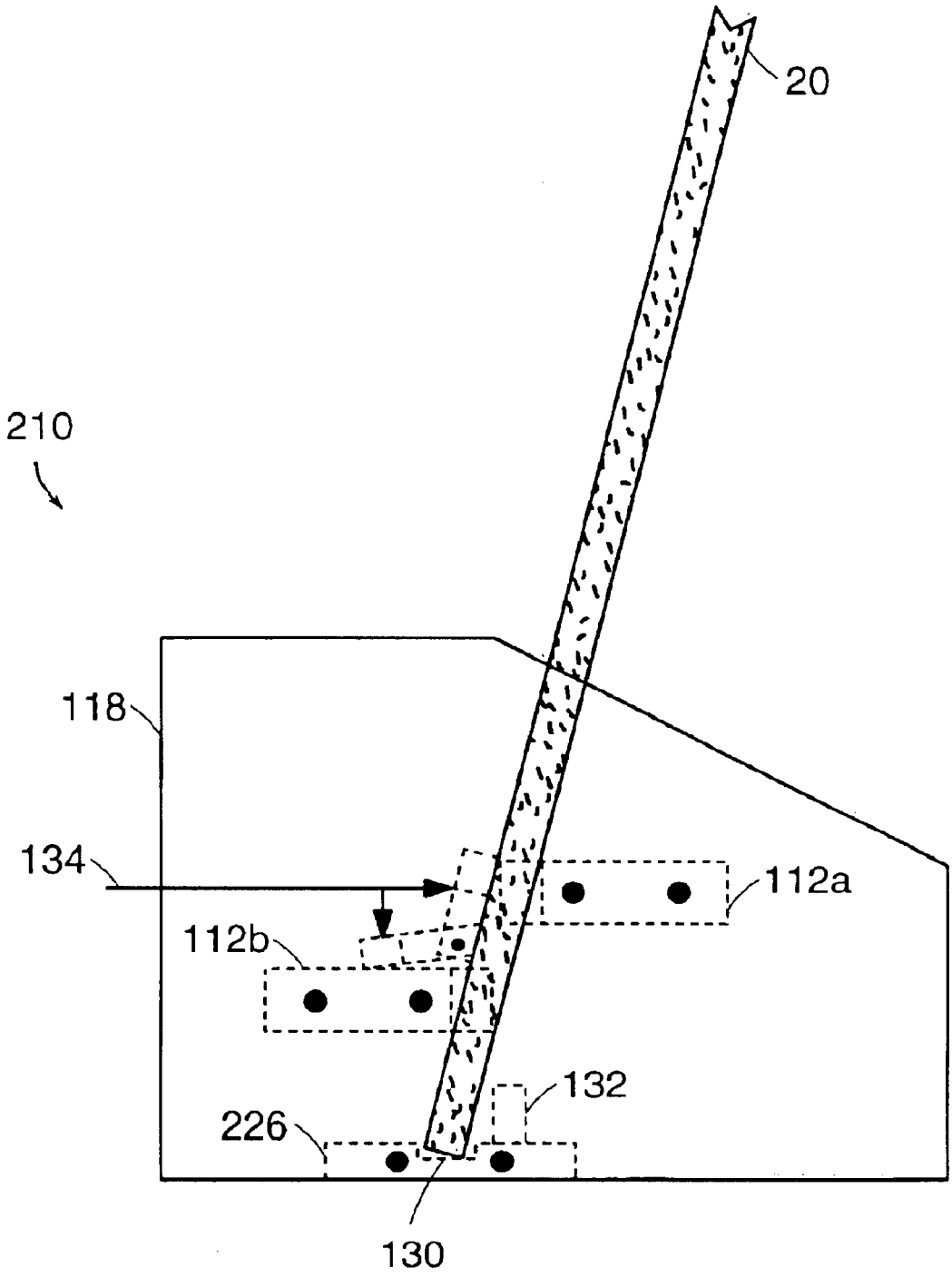
FIG. 5 is a schematic side view of a tool holder according to another embodiment of the invention.

FIG. 5 depicts several examples of optional devices and features that can be used to further secure the tool in its resting position. The coefficient of friction can be increased between the lower end of the elongate member 20 and the base plate 226, so that more force is required to dislodge the tool. For example, rubber matting can be disposed on an upper surface of the base plate 226 making it more difficult to accidentally knock a tool out of its resting position. The base plate 226 can also have a depression 130, such as a notch or a groove, formed therein, so that the lower end of the elongate member 20 becomes substantially trapped in place. In other words, the depression 130 prevents the lower end of the elongate member 20 from pivoting about the lower crossbar 112*b*. In this way, the elongate member 20 cannot be accidentally dislodged from its resting position. The placement of the lower end of the elongate member 20 in the notch or groove 130 prevents the elongate member 20 from toppling over the lower crossbar 112*b*. Alternatively or additionally, this safety feature can be accomplished by a tool stop 132. Instead of or in addition to the depression 130, the tool stop 132 is mounted on the base plate 226 to the side of the elongate member 20 closer to the upper crossbar 112*a* and is used to prevent the lower end of the elongate member 20 from pivoting about the lower crossbar 112*b*. These methods may require a user to pull the elongate member 20 out slightly in the general direction that it is resting until the lower end clears the depression 130 in the baseplate 226 or the tool stop 132, before it can be vertically pulled out of the tool holder 210; however, the effort is slight.

A lock bar 134, that may be hinged to the end plates 118 or lower crossbar 112*b*, may be used to hold securely the elongate member 20 in place. The lock bar 134 is shown in both retracted and engaged or locked positions. Pins, levers, bi-stable bar linkages, and other mechanisms known in the art can be used to secure the lock bar 134 in the locked position. The lock bar 134 can also be spring-loaded in the locked position, requiring a positive release, for example using a foot pedal or other actuation, to retract the bar 134 and remove a tool.

Figure 6:
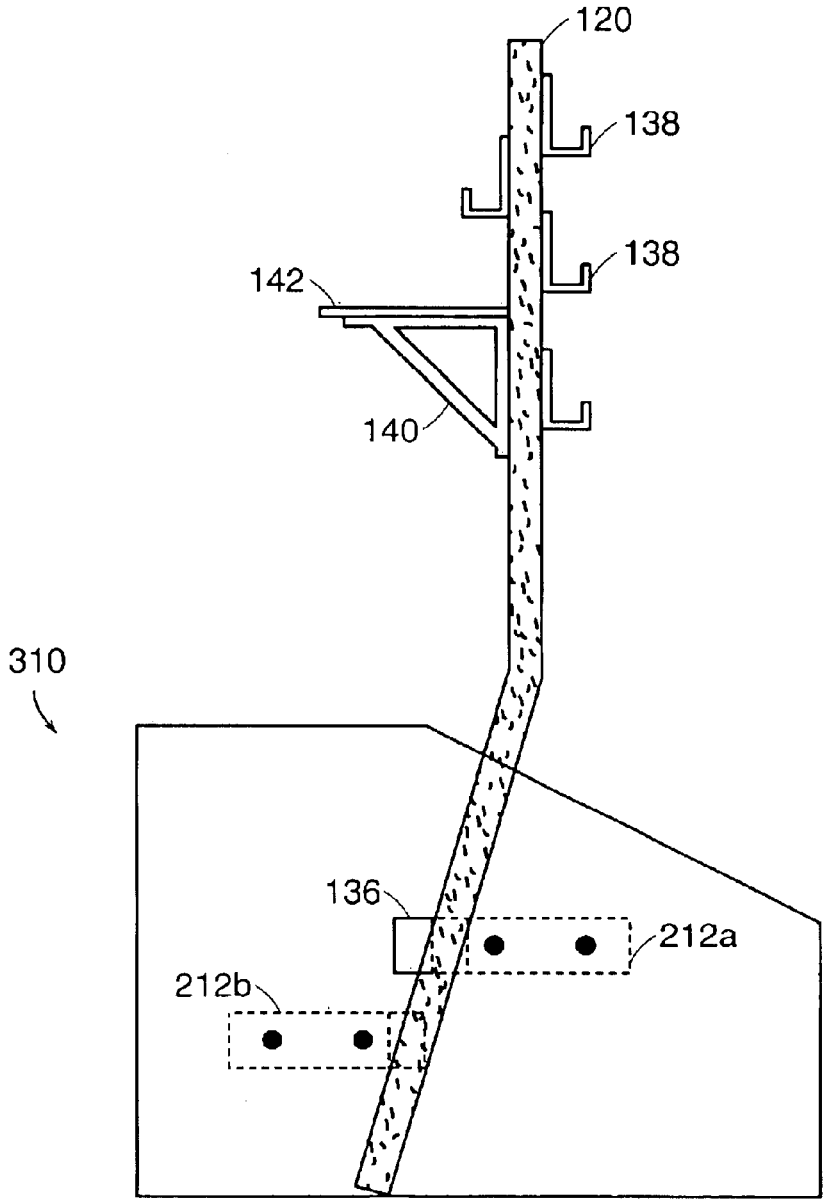
FIG. 6 is a schematic side view of a tool holder according to yet another embodiment of the invention.
Figure 7:
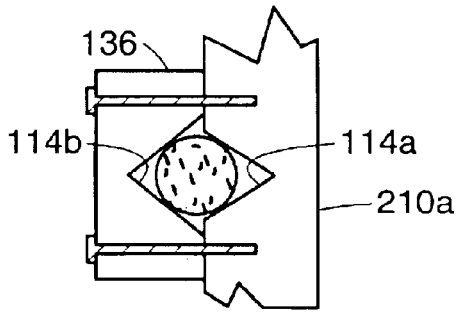
FIG. 7 is a schematic partial plan view of a support locking device detail of FIG. 6.

Alternatively, a fixed locking device 136 as shown in FIGS. 6–7, can also be provided for each tool location for semi-permanent retention of an elongate member 120, such as a support. The locking device 136 optionally includes a depression 114*b* formed in an edge of the locking device 136 that faces the depression 114*a* of at least one of the crossbars 212 to create an aperture for receiving the elongate member 120. The locking device 136, as shown attached to the upper crossbar 212*a*, can be removably or permanently attached to the crossbar 212*a* by a variety of methods including using nails, screws, bolts, latches, quick release mechanisms, magnets, adhesives, solder, weld, etc., depending on the materials used. The locking device 136 could also be integrally formed with the elongate member 120 or crossbar 212*a*.

In FIG. 6, the elongate member 120 shown is a support, which is semi-permanently installed in the tool holder 310. When used as supports, one or more elongate members 120 may have mounting devices 138 such as hangers, hooks, and clips, disposed thereon to hang or otherwise organize and hold suitable articles. The hooks could also be used to hang pegboard. The elongate members 120 may also have mounted thereto other support structures, such as brackets 140 to support shelves 142. Other devices that can be coupled to the elongate members 120 to facilitate organization and storage will be apparent to those skilled in the art. As depicted, the elongate members 120 may be non-linear, having at least one bend along the length thereof to provide an upper portion with a substantially vertical orientation to provide horizontal shelving 142.

The tool holder may be made of any type of material including natural wood or manufactured woods products, synthetic polymers, metal products including sheet metal, structural metal, or formed metal wire, or a combination thereof. For example, the material may be an injection molded lightweight plastic material, which may be desirable due to the low cost and the resistance to rot, decay, rusting, etc. The lightweight material also can make the tool holder easy to ship and handle by a user. Should lightweight materials be considered, any one or more of the methods for making the tool holder stable, as described above, can be implemented. The tool holder may be manufactured as an integral unit, or it may be manufactured in pieces that require some degree of assembly by the user. In addition, the units may be equipped with linking features such as mating bolt holes, tongue and groove surfaces, clamps, or other structure on the endplates or elsewhere to facilitate linking together two or more holders to produce a larger tool holder. Moreover, the tool holder could have two wheels and a handle so that it can be tipped slightly and rolled, or three or more wheels so that it can be rolled without any tipping.

Tool holders according to various embodiments of the invention can be made in a variety of sizes to suit individual applications. For example, for typical domestic use, the endplates can have a width between about 12 inches and 24 inches and a height between about 8 inches and 24 inches. The lower rail or crossbar can be disposed between about zero inches and 12 inches above the ground and the upper rail or crossbar disposed between about zero inches and 12 inches above the lower. Longitudinal spacing of notches or depressions in the rails can be between about 2 inches and 6 inches, with horizontal spacing between the apexes of the notches or roots of triangularly-shaped depressions between about 2 inches and 6 inches. Not all rails require depressions, however. For those rails without depressions, opposing edges can be spaced horizontally between about 2 inches and 6 inches. In general, angular tilt or lean of the elongate member in the holder should be between about zero degrees and 45 degrees from vertical, preferably between about 5 degrees and 35 degrees, more preferably between about 10 degrees and 25 degrees. The overall length of the tool holder can be between about 24 inches and 72 inches and, as discussed above, multiple tool holders can be linked together, if desired. These values are only exemplary and values outside these ranges are consistent with and fall within the scope of the invention.

Figure 8A:
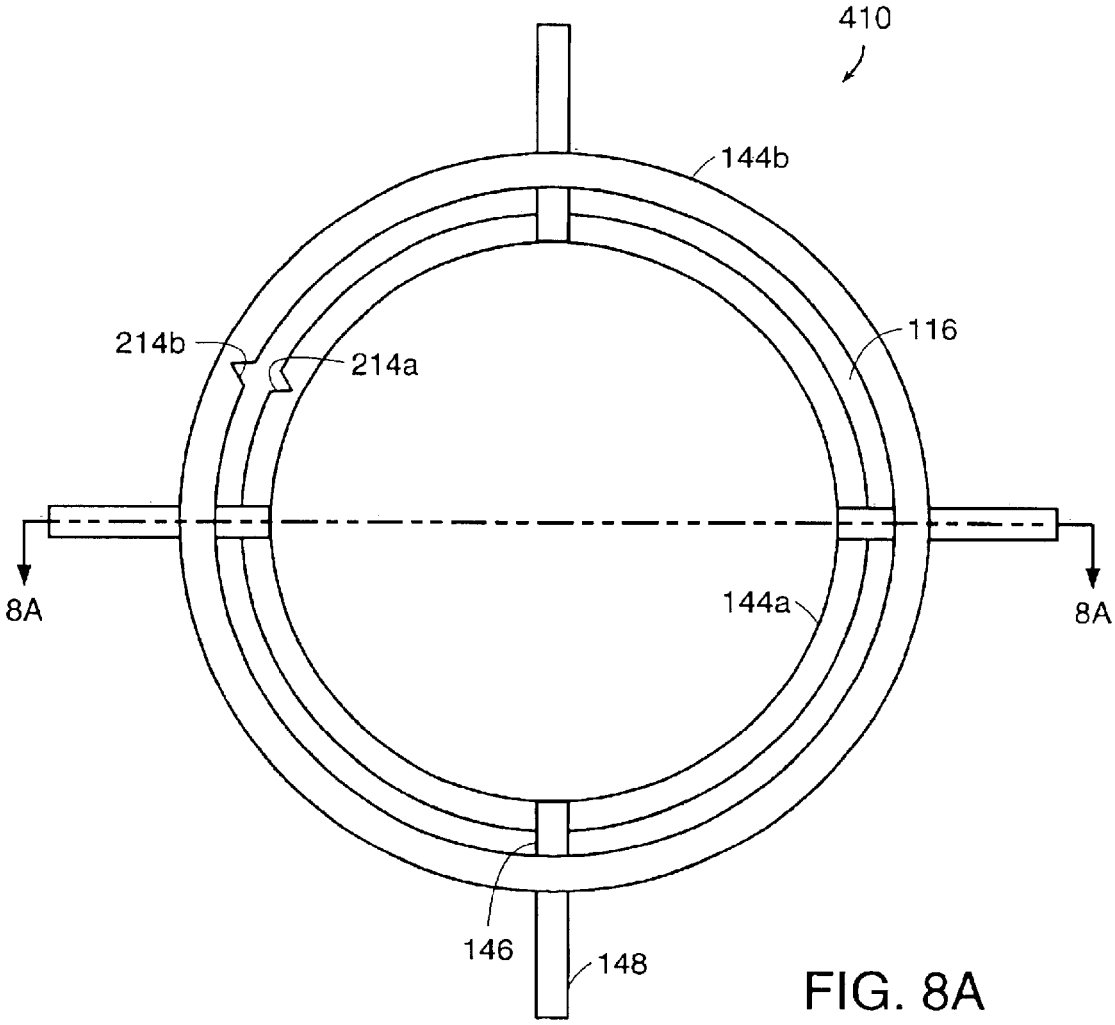
FIGS. 8A–8B are a schematic plan view and a cross-sectional view taken along section 8A—8A of yet another embodiment of the invention.
Figure 8B:
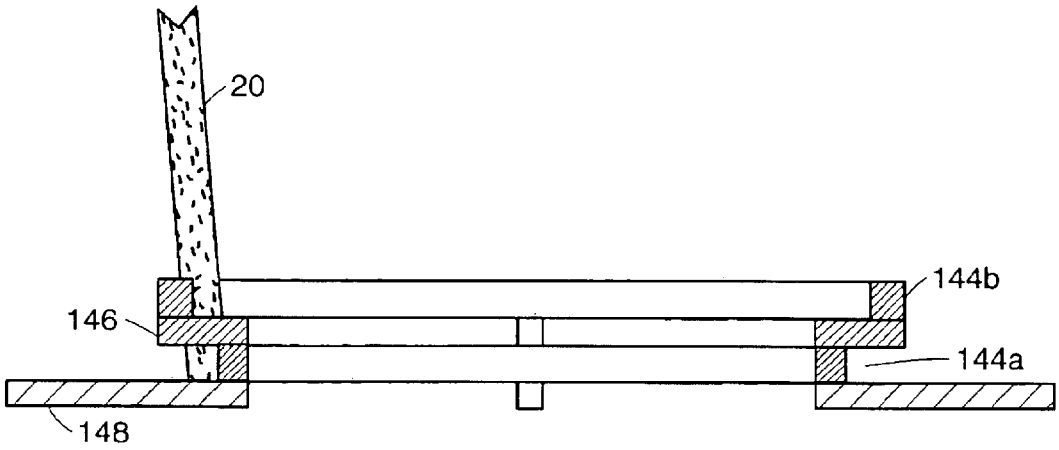

As discussed hereinabove, the rails can be flat generally parallel crossbars or they can be arcuate sections in the form of sectors or entire hoops. FIGS. 8A–8B are a schematic plan view and a cross-sectional view taken along section 8A—8A of a hoop-style tool holder 410. The tool holder 410 includes first and second rails in the form of inner and outer hoops 144*a*, 144*b*. The hoops 144*a*, 144*b* are generally concentric and offset vertically, forming a gap 116 therebetween for receiving the lower end of an elongate member 20. As with the crossbars, the hoops 144*a*, 144*b* have generally opposed edges for contacting and supporting the elongate member 20 when inserted into the tool holder 410. The hoops 144*a*, 144*b* may also have one or more depressions 214 formed therein to further restrain the elongate member 20. As shown in FIG. 8A, the inner and outer hoops 144*a*, 144*b* include respective generally radially aligned depressions 214*a*, 214*b* for cradling and restricting circumferential or lateral movement of the member 20.

The inner hoop 144*a* is of a smaller diameter than and disposed below the outer hoop 144*b* at a distance defined by a plurality of spacers 146, four being shown here. Accordingly, when inserted, the elongate member 20 leans radially outwardly, as shown in FIG. 8B. In order to maintain the center of mass of the tool within the footprint of the tool holder 410, a plurality of radially disposed outriggers or legs 148 are provided to increase the radial span of the tool holder 410. As used herein, a leg is defined as any structure used to increase the radial span of the tool holder 410 beyond the diameter of the outer hoop 144*b*, thereby forming a more stable structure. Four radial legs 148 are depicted here, although as few as three radial legs can be used and, in the limit, a single leg in the form of a large diameter annulus, disk, or frustoconical member can be used. The actual form of the leg(s) 148 is not particularly important, as long at the outward extents of the leg(s) 148 collectively form a footprint which is of sufficient effective diameter that a vertical projection through a center of gravity of the elongate member 20 inserted between the hoops 144 lies within the footprint. Alternatively or additionally the tool holder 410 could be suitable weighted in a central region thereof, as discussed above, to minimize or obviate the need for any legs 148.

Figure 9A:
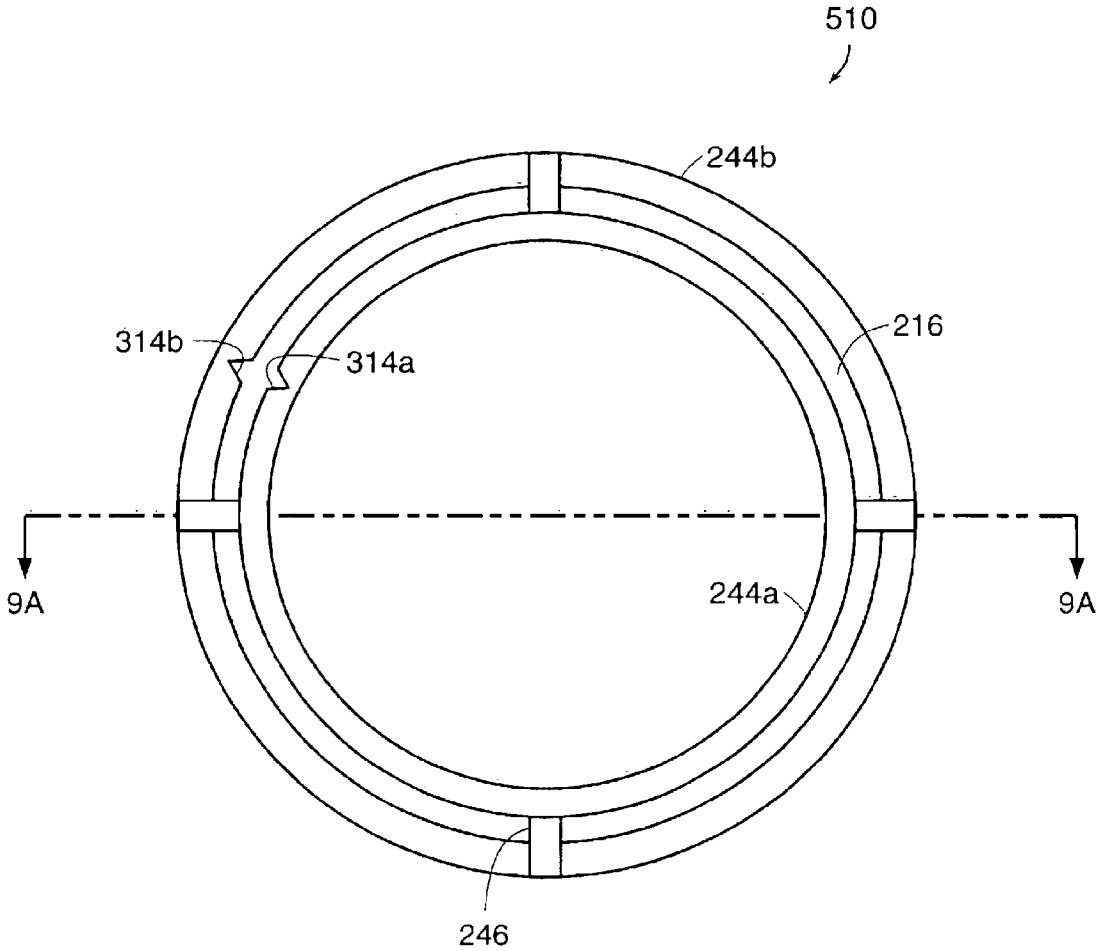
FIGS. 9A–9B are a schematic plan view and a cross-sectional view taken along section 9A—9A of still another embodiment of the invention.
Figure 9B:
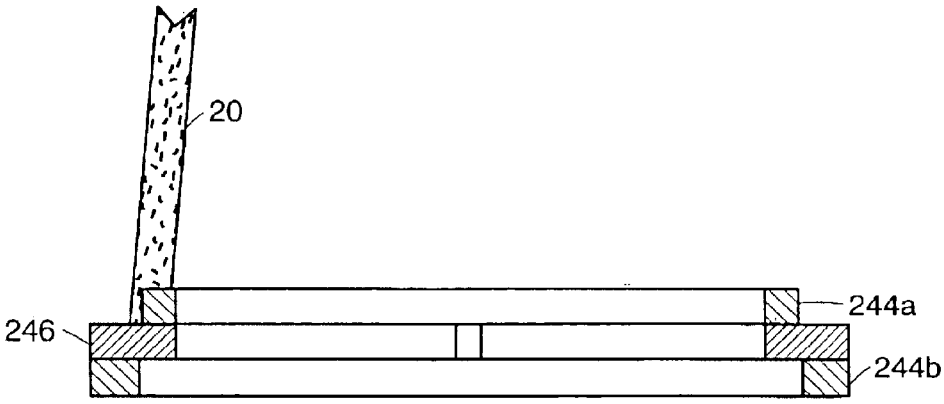

FIGS. 9A–9B are a schematic plan view and a cross-sectional view taken along section 9A—9A of another hoop-style tool holder 510 of a different overall configuration. The tool holder 510 includes first and second rails in the form of inner and outer hoops 244*a*, 244*b*. The hoops 244*a*, 244*b* are generally concentric and offset vertically, forming a gap 216 therebetween for receiving the lower end of an elongate member 20. As with the crossbars, the hoops 244*a*, 244*b* have generally opposed edges for contacting and supporting the elongate member 20 when inserted into the tool holder 510. The hoops 244*a*, 244*b* may also have one or more depressions 314 formed therein to further restrain the elongate member 20. As shown in FIG. 9A, the inner and outer hoops 244*a*, 244*b* include respective generally radially aligned depressions 314*a*, 314*b* for cradling and restricting circumferential or lateral movement of the member 20.

The inner hoop 244*a* is of a smaller diameter than and disposed above the outer hoop 244*b* at a distance defined by a plurality of spacers 246, four being shown here. Accordingly, when inserted, the elongate member 20 leans radially inwardly, as shown in FIG. 9B. As a result, unless the tool is very long or the tilt angle very large, it is not at all difficult to maintain the center of mass of the tool within the footprint of the tool holder 510, which is defined by the vertical projection of the outer hoop 244*b*. Thus, radially disposed outriggers or legs need not be provided to increase the radial span of the tool holder 510 in order to provide a stable structure. This tool holder 510 also permits insertion of the tool member 20 with minimal lifting, insofar as the lower end of the member need only be lifted over the outer lower hoop 244*b*, which can rest on the ground or be raised, if desired, on a plinth.

While these hoop-style tool holders can be made of a variety of materials, as discussed above, the configuration is well suited for manufacture from welded or brazed metal tubing, which provides very high strength and durability in a very low profile design. In an exemplary embodiment, the outer diameter of the larger hoop can be on the order of about 12 inches or less to about 48 inches or more, with other spacing, height, and angle value ranges similar to those value ranges discussed above.

Tool holders, in accordance with various embodiments of the invention are useful not only in domestic applications, but also are suitable for use in point-of-sale displays in retail establishments, as well as in commercial and industrial applications.

Having described preferred and exemplary embodiments of the invention, it will be apparent to those of ordinary skill in the art that other embodiments incorporating the concepts disclosed herein can be implemented without departing from the spirit and scope of the invention. The described embodiments and numerical values are to be considered in all respects only as illustrative and not restrictive.

What is claimed is:

1. A freestanding tool holding device comprises:

a first rail; and a second rail vertically and horizontally offset from the fist rail thereby forming an opening therebetween for receiving a lower end of an elongate member therein, the rails comprising generally parallel crossbars and being further characterized by generally opposed edges for simultaneously contacting and exerting reaction fores on the elongate member when inserted and disposed in a leaning orientation therebetween, thereby restraining the elongate member in a generally vertical and leaning orientation; and two end plates attached to side edges of the crossbars, whereby the end plates and the crossbars form a stable structure, said tool holding device lacking a base plate for supporting the lower end of the elongate member when received between the rails.

2. A device according to claim 1 further characterized by at least one depression formed in at least one of the opposed edges.

3. A device according to claim 2 wherein two depressions are formed in the opposed edges, and are generally aligned, to further restrain the elongate member when disposed therein.

4. A device according to claim 1 wherein outward extents of the end plates define a footprint and wherein a vertical projection through a center of gravity of an elongate member inserted between the crossbars lies within the footprint.

5. A method for swing elongate members in a generally vertical and leaning orientation, the method comprising the steps of:

providing a freestanding tool holding device comprising a first rail and a second rail, said rails vertically and horizontally offset from each other to form an opening therebetween for receiving a lower end of an elongate member therein, the rails comprising generally parallel crossbars and being further characterized by generally opposed edges for simultaneously contacting and exerting reaction forces on the elongate member when inserted and disposed in a leaning orientation therebetween, the device further comprising two end plates attached to side edges of the crossbars, whereby the end plates and the crossbar form a stable structure;

inserting a lower end of an elongate member in the opening between said rails without providing a base plate for supporting the lower end of the elongate member when received seen said rails; and leaning the elongate member against the rails.

6. A method according to claim 5 further comprising forming at least one depression in at least one of said rails along said opposed edges.

7. A method according to claim 5 further comprising forming two depressions along said opposed edges wherein said depressions are generally aligned, to further restrain the elongate member when the lower end thereof is disposed between said rails.

* * * * *